US010124988B2

(12) United States Patent
Tokura

(10) Patent No.: US 10,124,988 B2
(45) Date of Patent: Nov. 13, 2018

(54) ELEVATOR SYSTEM

(71) Applicant: Mitsubishi Electric Corporation, Chiyoda-ku (JP)

(72) Inventor: Sakurako Tokura, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 612 days.

(21) Appl. No.: 14/659,987

(22) Filed: Mar. 17, 2015

(65) Prior Publication Data

US 2016/0130113 A1 May 12, 2016

(30) Foreign Application Priority Data

Nov. 7, 2014 (JP) ..... 2014-226606

(51) Int. Cl.
*B66B 1/34* (2006.01)
*B66B 3/00* (2006.01)
*B66B 1/46* (2006.01)

(52) U.S. Cl.
CPC ..... *B66B 1/3461* (2013.01); *B66B 1/468* (2013.01); *B66B 3/006* (2013.01); *B66B 2201/4615* (2013.01); *B66B 2201/4653* (2013.01)

(58) Field of Classification Search
CPC ... B66F 3/46; B66F 3/24; G06F 21/00; B66B 1/3461; B66B 1/468; B66B 3/006; B66B 2201/4615; B66B 2201/4653
(Continued)

(56) References Cited

U.S. PATENT DOCUMENTS

2007/0007086 A1* 1/2007 Sirag, Jr. ..... B66B 1/2458 187/384
2009/0301820 A1* 12/2009 Stanley ..... B66B 1/34 187/382

(Continued)

FOREIGN PATENT DOCUMENTS

CN 1914109 A 2/2007
CN 102196984 A 9/2011

(Continued)

OTHER PUBLICATIONS

Japanese Office Action dated Jan. 23, 2018 in Japanese Patent Application No. 2014-226606 (with unedited computer generated English translation), citing documents AO, AP and AQ therein, 8 pages.

(Continued)

*Primary Examiner* — Jeffrey Donels
(74) *Attorney, Agent, or Firm* — Oblon, McClelland, Maier & Neustadt, L.L.P.

(57) ABSTRACT

An elevator system of this disclosure includes: a personal information terminal, which is carried by an elevator user and includes a display unit configured to represent a plurality of available services and a selecting unit by which it is possible to select a service by the display unit; and an elevator control device, which assigns a car of an elevator group according to call registration information from the personal information terminal and transmits information on the assigned car to the personal information terminal, wherein in a case where assigned car is changed due to the situation of the elevator group, the elevator control device changes the assigned car of the elevator group and displays a reassigned car for the user on the display unit of the personal information terminal.

7 Claims, 4 Drawing Sheets

(58) Field of Classification Search
USPC ..... 187/247, 391
See application file for complete search history.

(56) References Cited

U.S. PATENT DOCUMENTS

| | | | | |
|---|---|---|---|---|
| 2012/0253658 | A1* | 10/2012 | Kappeler | B66B 1/468 701/410 |
| 2014/0339023 | A1* | 11/2014 | Friedli | B66B 1/2408 187/247 |
| 2016/0122157 | A1* | 5/2016 | Keser | B66B 1/468 187/388 |

FOREIGN PATENT DOCUMENTS

| | | | |
|---|---|---|---|
| CN | 103863911 | A | 6/2014 |
| JP | 57-151360 | U1 | 3/1956 |
| JP | 2-163274 | A | 6/1990 |
| JP | 2003-192244 | A | 7/2003 |
| JP | 2004-175519 | | 6/2004 |
| JP | 2007-261753 | A | 10/2007 |
| JP | 2009-527936 | A | 7/2009 |
| JP | 2009-220924 | | 10/2009 |
| JP | 2011-136836 | A | 7/2011 |
| JP | 5457618 | | 4/2014 |
| JP | 2014-118263 | A | 6/2014 |

OTHER PUBLICATIONS

Combined Office Action and Search Report dated Oct. 31, 2017 in Chinese Patent Application No. 201510181215.2 (with English language translation of Office Action and English translation of categories of cited documents citing documents AO-AT therein, 16 pages).

Office Action dated Apr. 3, 2018 in Japanese Patent Application No. 2014-226606 with unedited computer generated English translation, citing document AO therein, 8 pages.

Office Action dated Jul. 3, 2018 in Chinese Patent Application No. 201510181215.2 with English Translation.

* cited by examiner

ELEVATOR SYSTEM

CROSS-REFERENCE TO RELATED APPLICATION

This application claims priority from Japanese Patent Application No. 2014-226606 filed on Nov. 7, 2014, the entire subject matter of which is incorporated herein by reference.

TECHNICAL FIELD

This disclosure relates to an elevator system, in which a car is operated according to service request information from a personal information terminal.

BACKGROUND

In a background elevator system, according to data received from a personal information terminal such as a mobile phone and representing a departure floor and a destination floor, a car operation is controlled, and audio guidance or the like is output to a user (see JP-A-2004-175519). Also, in a background elevator system, according to call registration information from a personal information terminal, changing of a assigned car is prohibited, and thus an assigned car cannot be changed, the exact assigned car is notified to a user (see JP-B-5457618).

SUMMARY

In a case of applying the background elevator system as described above to a group management control elevator system, a car is assigned according to call registration information from a personal information terminal, and information on the assigned car is transmitted to the personal information terminal, whereby the assigned car is notified to a user. However, even if the most appropriate assigned car is changed due to an operation of an elevator group before the assigned car reaches the floor according to the call registration information, it is impossible to notify the changing of the assigned car to the user at an appropriate timing.

This disclosure is to provide an elevator system capable of notifying the most appropriate assigned car to a user at an appropriate timing, thereby capable of improving convenience.

An elevator system of this disclosure includes: a personal information terminal, which is carried by an elevator user and includes a display unit configured to represent a plurality of available services and a selecting unit by which it is possible to select a service by the display unit; and an elevator control device, which assigns a car of an elevator group according to call registration information from the personal information terminal and transmits information on the assigned car to the personal information terminal, wherein in a case where assigned car is changed due to the situation of the elevator group, the elevator control device changes the assigned car of the elevator group and displays a reassigned car for the user on the display unit of the personal information terminal. of this disclosure, Since the elevator control device according to this disclosure is configured as described above, if the most appropriate assigned car is changed with respect to call registration information from the personal information terminal, the elevator system of this disclosure notifies the changing of assigned car to the user, thereby capable of improving convenience.

BRIEF DESCRIPTION OF THE DRAWINGS

The foregoing and additional features and characteristics of this disclosure will become more apparent from the following detailed descriptions considered with the reference to the accompanying drawings, wherein.

DETAILED DESCRIPTION

First Embodiment

Hereinafter, embodiments of this disclosure will be described with reference to the accompanying drawings.

Figure 1:
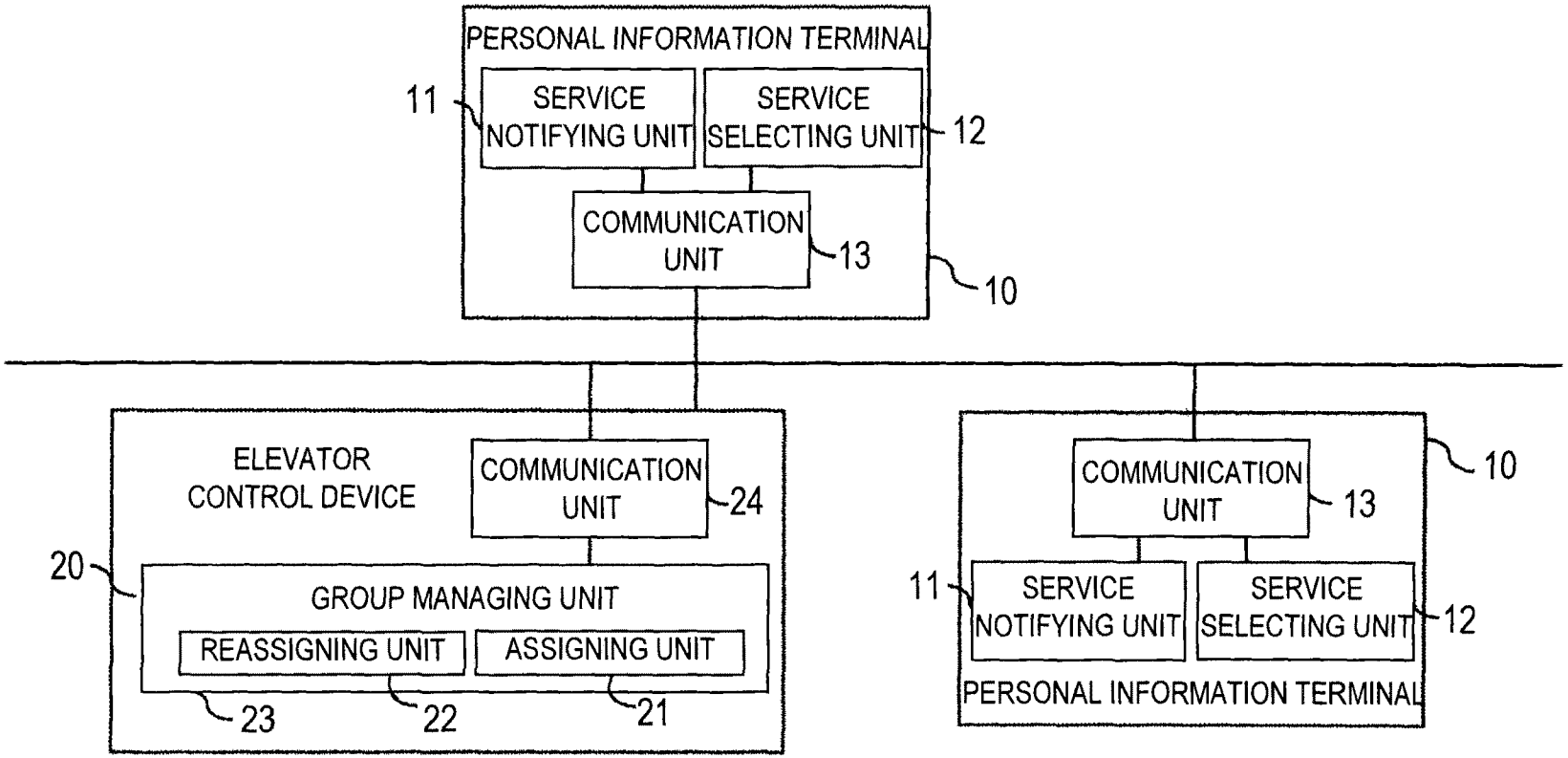
FIG. 1 is a view illustrating the overall configuration of an elevator system according to a first embodiment of this disclosure.

FIG. 1 is a view illustrating the overall configuration of an elevator system according to a first embodiment of this disclosure.

In FIG. 1, a reference symbol "10" represents a personal information terminal by which a user uses for a call registration request.

A personal information terminal 10 includes a service notifying unit 11 for notifying a user of services such as registration of a destination call in an elevator control device 20, for example, by text information, sound, or the like, a service selecting unit 12 for enabling the user to select a service by the service notifying unit 11, and a communication unit 13 for performing information communication between those unit and the elevator control device.

An operation of a car of each of a plurality of elevators (not shown) constituting an elevator group is controlled by respective machine controlling devices. Respective machine controlling devices are connected to the elevator control device 20. The elevator control device 20 includes a group managing unit 23 which includes an assigning unit 21 and a reassigning unit 22, and a communication unit 24 for performing communication with the personal information terminal 10.

Figure 2:
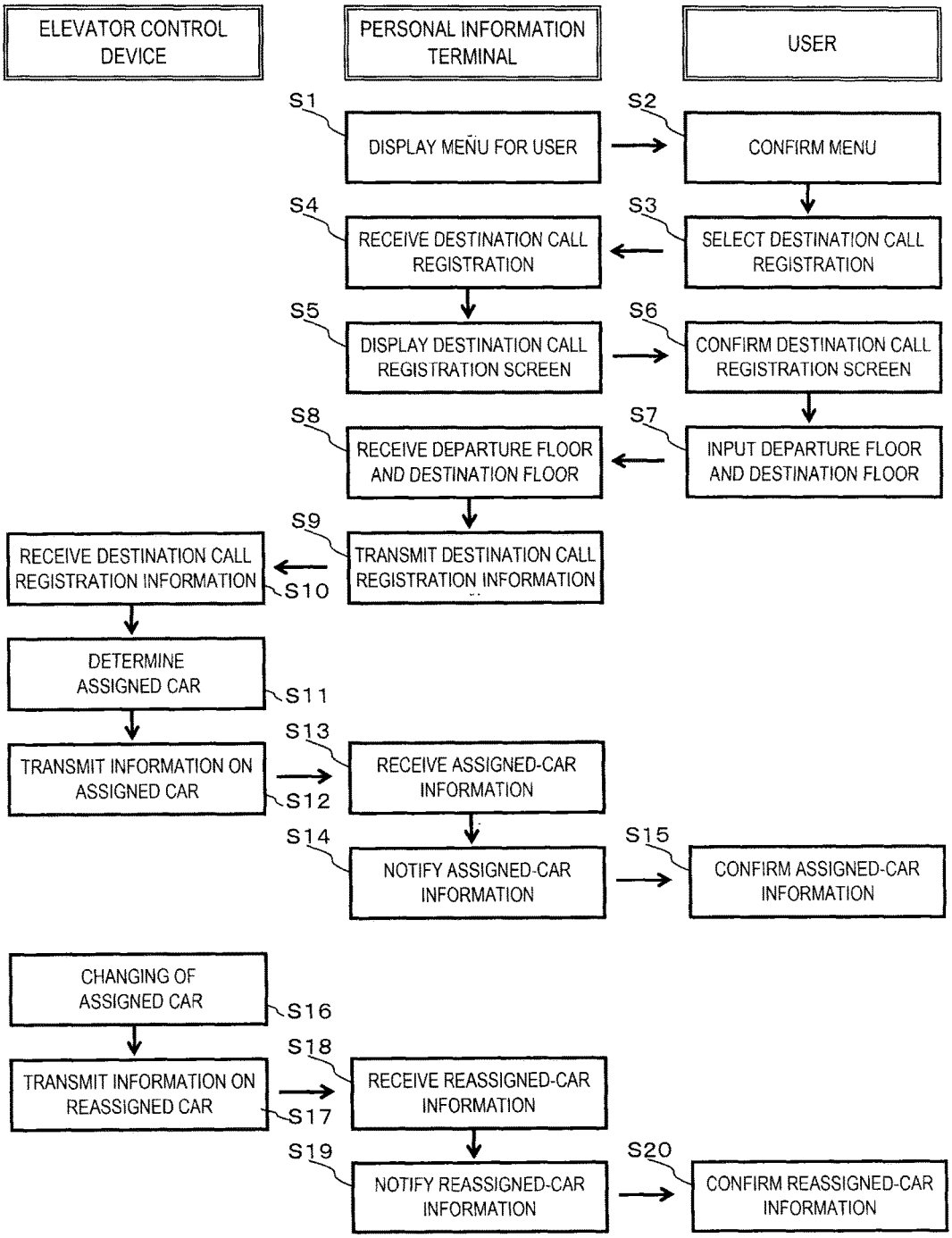
FIG. 2 is an explanatory view illustrating a communication operation among an elevator control device, a personal information terminal, and a user during elevator call registration according to the first embodiment of this disclosure.

Subsequently, an operation will be described. FIG. 2 is an explanatory view illustrating a communication operation among the personal information terminal 10, the elevator control device 20, and the user during elevator call registration according to this disclosure.

In FIG. 2, first, in Step S1, the service notifying unit 11 of the personal information terminal 10 displays a menu for the elevator user. The user confirms the menu in Step S2, and selects an item "DESTINATION CALL REGISTRATION" by the service selecting unit 12 of the personal information terminal 10 in Step S3.

Figure 3:
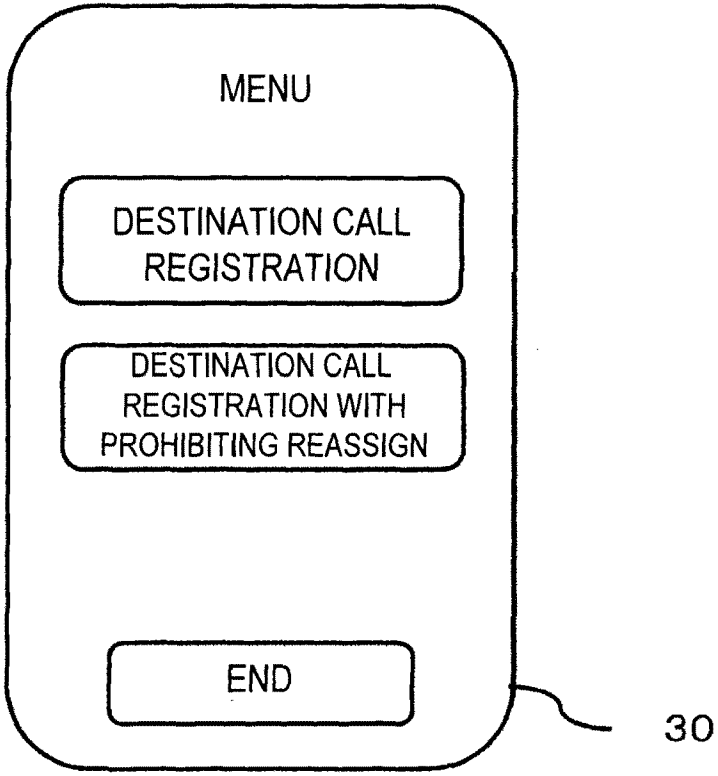
FIG. 3 is a view illustrating an example of the configuration of a main screen of the personal information terminal according to the first embodiment of this disclosure.

FIG. 3 shows an example of a menu screen 30 of the personal information terminal 10. If receiving the selection of the item "DESTINATION CALL REGISTRATION" from the elevator user in Step S4, the service notifying unit 11 of the personal information terminal 10 displays a destination call registration screen in Step S5.

Figure 4:
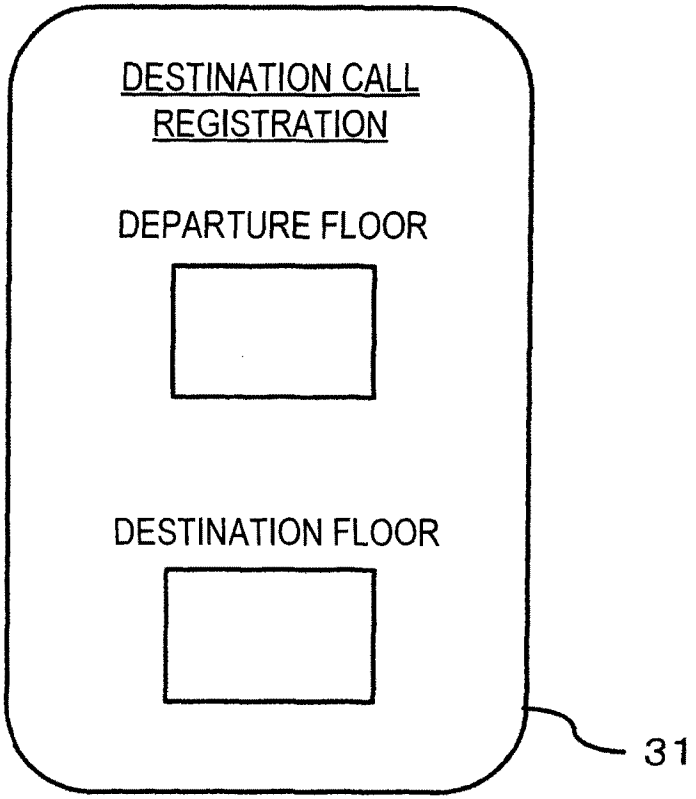
FIG. 4 is a view illustrating an example of the configuration of a destination call registration screen of the personal information terminal according to the first embodiment of this disclosure.

FIG. 4 shows an example of a destination call registration screen 31. The elevator user confirms the destination call registration screen 31 in Step S6, and inputs a departure floor and a destination floor by the service selecting unit 12 of the personal information terminal 10 in Step S7. If the personal information terminal 10 receives the departure floor and the destination floor from the elevator user in Step S8, the personal information terminal 10 transmits destination call registration information to the elevator control device 20 by the communication unit 13 in Step S9. If the elevator control device 20 receives the destination call registration information from the personal information terminal 10 by the communication unit 24 in Step S10, the elevator control device 20 assigns a car according to the destination call by the assigning unit 21 of the group managing unit 23 in Step S11, and transmits information on the assigned car to the personal information terminal 10 by the communication unit 24 in Step S12. If receiving the assigned-car information from the elevator control device 20 by the communication unit 13 in Step S13, the service notifying unit 11 of the personal information terminal 10 notifies the assigned car to the user in Step S14. Then, the user confirms the assigned car in Step S15.

Figure 5:
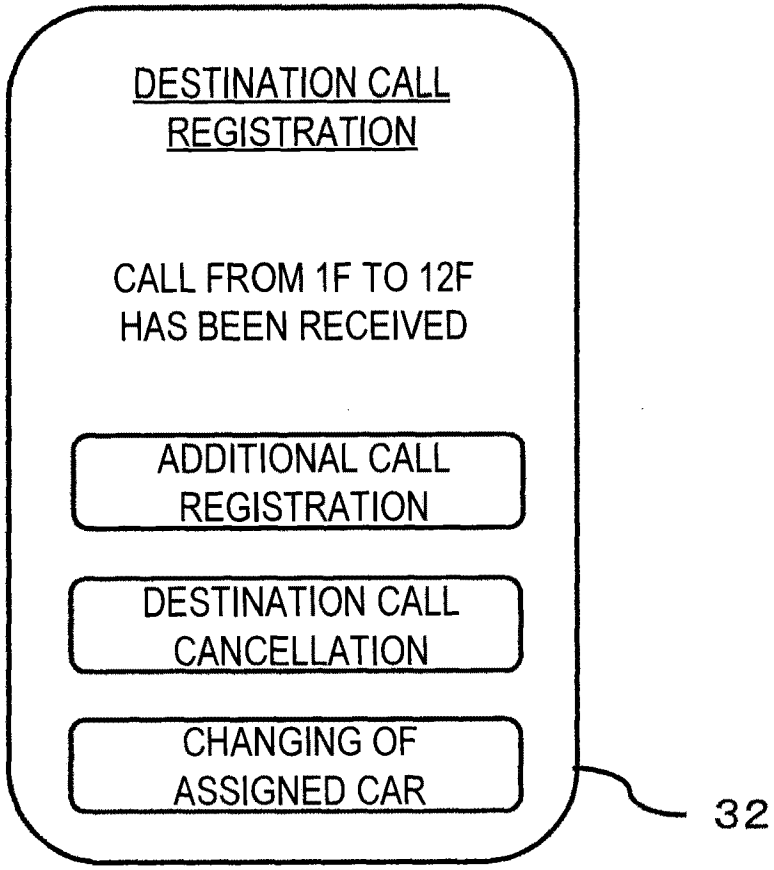
FIG. 5 is a view illustrating an example of the configuration of an assigned-car notification screen of the personal information terminal according to the first embodiment of this disclosure.

FIG. 5 shows an example of an assigned-car notification screen 32 of the personal information terminal 10. Thereafter, if a car which is the most appropriate for the destination call is changed, the group managing unit 23 of the elevator control device 20 changes the assigned car by the reassigning unit 22 in Step S16, and transmits information on the reassigned car to the personal information terminal 10 by the communication unit 24 in Step S17. If the personal information terminal 10 receives the reassigned-car information from the elevator control device 20 by the communication unit 13 in Step S18, the service notifying unit 11 of the personal information terminal 10 notifies the reassigned car in Step S19. Then, the user confirms the reassigned car in Step S20.

Figure 6:
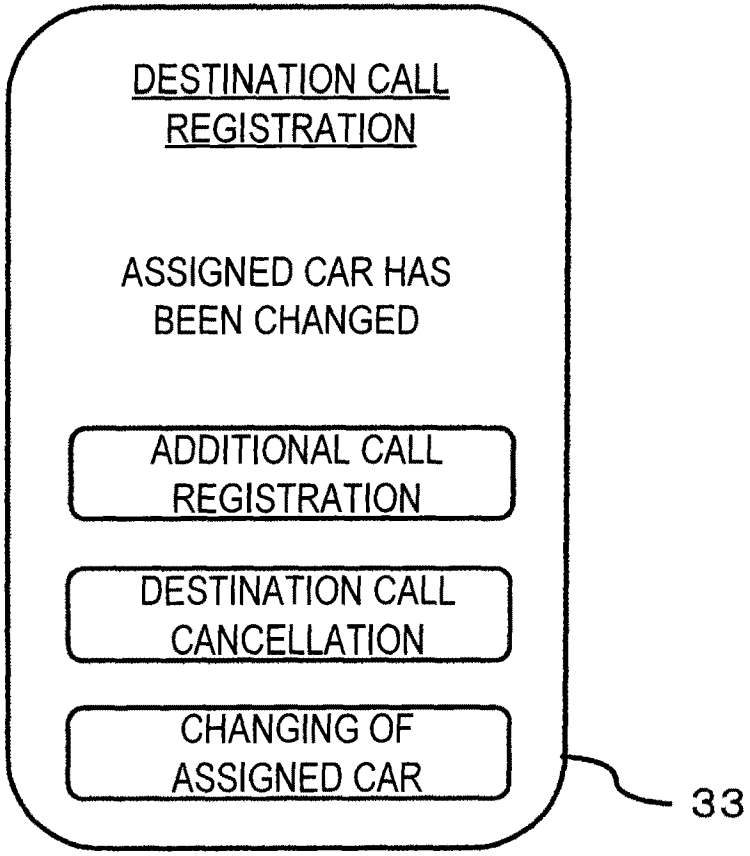
FIG. 6 is a view illustrating an example of the configuration of a reassigned-car notification screen of the personal information terminal according to the first embodiment of this disclosure.

FIG. 6 shows an example of a reassigned-car notification screen 33 of the personal information terminal 10. Also, in this case, the reason of the reassignment such as a text "ASSIGNED CAR HAS BEEN OPERATED FOR VIP" may be displayed on the reassigned-car notification screen 33, thereby being notified. Also, in a case where the elevator capable of moving to the destination floor has become unusable due to some reason such as an earthquake, information representing that "THE ELEVATOR BECOMES UNUSABLE" may be displayed on the reassigned-car notification screen 33, thereby being notified to the user. Also, in a case where there is no elevator capable of moving to the destination floor of the user, a floor close to the destination floor may be re-designated, and a car for the re-designated floor may be reassigned. Then, information on the reassigned car and information representing the change in the destination floor may be displayed on the reassigned-car notification screen 33, thereby being notified to the user.

In the elevator system as described above, after call registration, if the most appropriate assigned car is changed due to a change in the state of the elevator group, it is possible to change the assigned car, and notify information on the changed assigned car to respective corresponding users, thereby capable of improving convenience.

Second Embodiment

Subsequently, a second embodiment of this disclosure will be described. In the above described first embodiment, in Step S1, as shown in the menu screen 30, the menu may be displayed for the user such that the user can select an item "DESTINATION CALL REGISTRATION FOR REASSIGNMENT PROHIBITION". In a case where the item "DESTINATION CALL REGISTRATION WITH PROHIBITING REASSIGNMENT" is selected, even if the most appropriate car is changed, the assigned car would not be reassigned.

In the elevator system as described above, a user can register a destination call such that reassignment is prohibited, as necessary. Therefore, it is possible to prevent a situation in which whenever the most appropriate car is changed, a user having difficulty in moving, such as a physically challenged person needs to move to the front of the changed car.

Third Embodiment

Subsequently, a third embodiment of this disclosure will be described. In the above described first embodiment, when the assigned car is notified to the user in Step S14, the assigned-car notification screen 32 may include an item "ADDITIONAL CALL REGISTRATION". In this case, if the user selects the item "ADDITIONAL CALL REGISTRATION", the same car as the an original call may be assigned.

In the elevator system as described above, in a case where the user is with any other person, even if their destination floors are different from each other, they can move by the same car until getting off the elevator.

Fourth Embodiment

Subsequently, a fourth embodiment of this disclosure will be described. In the above described first embodiment, when the assigned car is notified to the user in Step S14, the assigned-car notification screen 32 may include an item "CHANGING OF ASSIGNED CAR". In this case, if the user selects the item "CHANGING OF ASSIGNED CAR", any other car than the assigned car notified to the user may be selected from the elevator group, and be reassigned. In this case, on the assigned-car notification screen 32, an image of the inside of the reassigned car may be displayed such that the user can confirm how crowded it is, and determine whether changing of assigned car is necessary.

In the above described elevator system, in a case where the user is dissatisfied with the assigned car, it is possible to reassign any other car, thereby capable of moving comfortably.

As described above, the elevator system according to this disclosure includes the personal information terminal, which is carried by the elevator user, and the elevator control device. The personal information terminal includes a display unit which represents a plurality of available services, and a selecting unit by which it is possible to select a service by the display unit. The elevator control device assigns a car of the elevator group according to call registration information from the personal information terminal and transmits information on the assigned car to the personal information terminal. In a case where assigned car is changed due to the situation of the elevator group, the elevator control device r changes the assigned car of the elevator group, and displays information on a reassigned car for the user on the display unit of the personal information terminal. Therefore, if the most appropriate assigned car is changed with respect to the call registration information from the personal information terminal, the changing of the assigned car is notified to the user, whereby it is possible to improve convenience.

Also, in the elevator system according to this disclosure, one of the plurality of available services is a reassignment prohibition request, and in a case where a command for a reassignment prohibition request is received from the personal information terminal, the elevator control device prohibits reassignment with respect to a corresponding call. Therefore, as necessary, the user can register a destination call such that reassignment is impossible. Therefore, it is possible to prevent a situation in which whenever the most appropriate assigned car is changed, a user having difficulty in moving, such as a physically challenged person needs to move to the front of the reassigned car.

Also, in the elevator system according to this disclosure, one of the plurality of available services is an additional call registration request, and in a case where a command for an additional call registration request is received from the personal information terminal, the elevator control device additionally assigns the same car as an original call. Therefore, in a case where the user is with any other person, even if their destination floors are different from each other, they can move by the same car until getting off the elevator.

Also, in the elevator system according to this disclosure, one of the plurality of available services is a call cancellation request, and in a case where a command for a call cancellation request is received from the personal information terminal, the elevator control device cancels a corresponding call and controls the display unit to display information representing that the corresponding call has been canceled. Therefore, it is possible to notify the user that the corresponding call has been cancelled.

Also, in the elevator system according to this disclosure, one of the plurality of available services is a request for changing assigned car, and in a case where a command for a request for changing assigned car is received from the personal information terminal, the elevator control device selects any other car than the car for an original call, from the elevator group, and changes the assigned car. Therefore, in a case where the user is dissatisfied with the assigned car, it is possible to reassign any other car, thereby capable of moving comfortably.

Also, in the elevator system according to this disclosure, when information on the reassigned car is transmitted to the personal information terminal, the elevator control device transmits the reason of the reassignment. Therefore, after call registration, if the most appropriate assigned car is changed due to a change in the state of the elevator group, it is possible to change the assigned car, and notify information on the reassigned car to respective corresponding users, thereby capable of improving convenience.

This disclosure can be applied to an elevator system which operates a car according to service request information from a personal information terminal.

What is claimed is:

1. An elevator system comprising:

a personal information terminal, which is configured to be carried by an elevator user, the personal information terminal includes a display unit configured to display a plurality of available services and a selecting unit that allows the elevator user to select a service displayed by the display unit; and an elevator control device, which assigns a car of an elevator group according to call registration information from the personal information terminal and transmits information on the assigned car to the personal information terminal, wherein if appropriate assigned car is changed due to the situation of the elevator group in a case where another assigned car other than the appropriate assigned car has already assigned for the user, the elevator control device reassigns the appropriate car of the elevator group to the user and displays a reassigned car for the user on the display unit of the personal information terminal.

2. The elevator system according to claim 1, wherein one of the plurality of available services is a reassignment prohibition request, and wherein in a case where a command for the reassignment prohibition request is received from the personal information terminal, the elevator control device prohibits reassignment with respect to a corresponding call.

3. The elevator system according to claim 1, wherein one of the plurality of available services is an additional call registration request, and wherein in a case where a command for the additional call registration request is received from the personal information terminal, the elevator control device additionally assigns the same car as an original call.

4. The elevator system according to claim 1, wherein one of the plurality of available services is a call cancellation request, and wherein in a case where a command for a call cancellation request is received from the personal information terminal, the elevator control device cancels a corresponding call and controls the display unit to display information representing that the corresponding call has been canceled.

5. The elevator system according to claim 1, wherein one of the plurality of available services is a request for changing assigned car, and wherein in a case where a command for a request for changing assigned car is received from the personal information terminal, the elevator control device selects any other car than the car for an original call, from the elevator group and changes the assigned car.

6. The elevator system according to claim 1, wherein when the information on the reassigned car is transmitted to the personal information terminal, the elevator control device transmits a reason of the reassignment.

7. An elevator system comprising:

an elevator group having plural elevators; and an elevator control device, which assigns an appropriate car from the elevator group according to a destination call registration information transmitted from a personal information terminal carried by an elevator user;

wherein the elevator control device reassigns an appropriate car from the elevator group according to a preliminarily selected service by the personal information terminal when the pre-assigned appropriate car is changed due to a change in a state of the elevator group, and makes the personal information terminal display a re-assigned car information.

* * * * *